US005490526A

United States Patent [19]

Irikura

[11] Patent Number: 5,490,526

[45] Date of Patent: Feb. 13, 1996

[54] APPARATUS FOR APPLYING AIR PRESSURE TO A ROD-SHAPED ARTICLE THROUGH WHICH AIR CAN BE CIRCULATED

[75] Inventor: Takayuki Irikura, Tokyo, Japan

[73] Assignee: Japan Tobacco Inc., Tokyo, Japan

[21] Appl. No.: 343,896

[22] Filed: Dec. 6, 1994

Related U.S. Application Data

[63] Continuation of Ser. No. 110,938, Aug. 24, 1993, abandoned.

[30] Foreign Application Priority Data

Aug. 24, 1992 [JP] Japan ..... 4-224147

[51] Int. Cl.[6] ..... A24C 5/00; A24C 5/60

[52] U.S. Cl. ..... 131/280; 131/904

[58] Field of Search ..... 131/904, 280, 131/84.1; 73/49.8, 37, 38

[56] References Cited

U.S. PATENT DOCUMENTS

| | | | |
|---|---|---|---|
| 3,948,084 | 4/1976 | Heitmann et al. | 73/49.8 X |
| 3,999,134 | 12/1976 | Lorenzen | 131/908 X |
| 4,103,535 | 8/1978 | Mutter et al. | 73/37.5 |
| 4,403,619 | 9/1983 | Dahlgrun | 131/908 X |
| 4,955,398 | 9/1990 | Milner et al. | 131/904 X |
| 5,117,845 | 6/1992 | Poulet et al. | 131/904 X |
| 5,179,965 | 1/1993 | Komori et al. | 131/904 X |
| 5,186,183 | 2/1993 | Komori et al. | 131/904 X |
| 5,369,986 | 12/1994 | Koch | 73/38 X |

FOREIGN PATENT DOCUMENTS

| | | | |
|---|---|---|---|
| 3-179236 | 8/1991 | Japan . | |
| 2069144 | 8/1981 | United Kingdom | 131/281 |

*Primary Examiner*—Jennifer Bahr
*Attorney, Agent, or Firm*—Birch, Stewart, Kolasch & Birch

[57] ABSTRACT

An apparatus has an inspection drum, suction grooves arranged on the outer peripheral surface of the inspection drum and adapted to receive and transport filter cigarettes as the inspection drum rotates, and pads arranged on the inspection drum so as to be situated on either side of the suction grooves. Each pad has a pad face opposed to its corresponding suction groove and an elastically deformable, ring-shaped bulging portion formed on the pad face. When a filter cigarette in the suction groove is transported to a predetermined position, the respective bulging portions of the paired pads on either side of the suction groove are pressed individually against the opposite ends of the filter cigarette, so that the bulging portions are elastically deformed to be brought into intimate contact with the end faces of the filter cigarette.

10 Claims, 6 Drawing Sheets

APPARATUS FOR APPLYING AIR PRESSURE TO A ROD-SHAPED ARTICLE THROUGH WHICH AIR CAN BE CIRCULATED

This application is a continuation of application Ser. No. 08/110,938 filed on Aug. 24, 1993, now abandoned.

BACKGROUND OF THE INVENTION

1. Field of the Invention

The present invention relates to an apparatus for applying air pressure to one end of a filter cigarette, as a rod-shaped article, in order to check the filter cigarette for dilution.

2. Description of the Related Art

A filter cigarette is composed of a cigarette and a filter which is connected to one end of the cigarette by means of a paper piece wound thereon. In filter cigarettes of some kinds, the paper piece or paper ring is formed having a plurality of pores. When a filter cigarette of this type is smoked, smoke inhaled by a smoker is diluted by air introduced through cigarette paper and pores therein. Since this introduction of air lowers the temperature of the smoke, nicotine and tar in the smoke are reduced in quantity, so that the smoker can enjoy light taste of smoke.

Unless the quantity of air introduced through the pores in the individual filter cigarettes and the cigarette paper, that is, the dilution of the smoke, with regards to the manufacture of the filter cigarettes of this type, is constant, therefore, the taste is unstable, and the quality of the filter cigarettes lacks in uniformity.

Accordingly, an inspection device for checking the individual filter cigarettes for dilution is incorporated in a filter cigarette manufacturing system. An example of this inspection device is described in Published Unexamined Japanese Patent Application No. 3-172936.

This conventional inspection device comprises an inspection drum, which constitutes part of a transportation path for filter cigarettes. More specifically, the inspection drum has a number of suction grooves on the outer peripheral surface thereof, the suction grooves serving to attract and transport the filter cigarettes as the inspection drum rotates.

Further, a pair of pads for each suction groove is arranged on the outer peripheral surface of the inspection drum. These pads, which are located on either side of the suction groove, move toward and away from each other as the inspection drum rotates. When a filter cigarette in the suction groove reaches a predetermined rotational angle zone, with respect to the rotating direction of the inspection drum, as the drum rotates, therefore, the paired pads corresponding to the suction groove are pressed individually against the opposite ends of the filter cigarette, thereby holding the filter cigarette between them.

An air pressure is applied to one end or the cigarette-side end of the filter cigarette through one pad, while an air pressure appearing at the other end or the filter-side end of the filter cigarette is outputted through the other pad. When the difference between the air pressures at the opposite ends of the filter cigarette, that is, the differential pressure between the input and output air pressures, is measured, the dilution of the filter cigarette can be detected by the differential pressure.

Since the dilution of the filter cigarette is detected on the basis of the aforesaid differential pressure, the input air pressure applied to the filter cigarette and the output air pressure delivered therefrom should be measured accurately. To attain this, the paired pads must be fully in intimate contact with the opposite ends of the filter cigarette during the inspection of the filter cigarette dilution. If there are gaps between the pads and the end faces of the filter cigarette, the measured input or output air pressure cannot represent an accurate value, so that the dilution, obtained according to the differential pressure between the input and output air pressures, is inaccurate.

However, each end face of the filter cigarette, especially the cigarette-side end face, is neither flat nor precisely round. Further, the cigarette-side end face is not necessarily perpendicular to the axis of the filter cigarette.

Even though the one pad is pressed against the cigarette-side end face, therefore, it is difficult to bring the pad and the cigarette-side end face into intimate contact with each other, and a gap may possibly be formed between them. As mentioned before, this gap lowers the reliability of the detection of the dilution of the filter cigarette.

If the rotating speed of the inspection drum increases with the increase of the operating speed of the manufacturing system, the time required for the filter cigarette to pass the rotational angle zone, that is, the period of time during which the paired pads are in intimate contact with the filter cigarette, becomes shorter. Thus, air leaking from the gap between the pad and the cigarette-side end face of the filter cigarette exerts a substantial bad influence upon the detection of the dilution.

SUMMARY OF THE INVENTION

The object of the present invention is to provide an apparatus adapted for use with an inspection device, such as the one described above, and in which an air pressure can be applied to one end face of a rod-shaped article, such as a filter cigarette, and an air pressure appearing at the other end face of the rod-shaped article can be outputted without entailing air leakage.

The above object Is achieved by an apparatus of the present invention for applying air pressure to a rod-shaped article through which air can be circulated. This apparatus comprises: transportation means for transporting a rod-shaped article, the transportation means including a transportation path along which the rod-shaped article is transported in the direction perpendicular to the axial direction thereof; a pair of pads arranged on either side of the transportation path, each of the pads having a pad face directed to the transportation path and an elastically deformable, ring-shaped bulging portion provided on the pad face and adapted to be pressed against the peripheral edge of the corresponding end face of the rod-shaped article when the rod-shaped article reaches a predetermined position; and input-output means adapted to apply an input air pressure to one end of the rod-shaped article through one of the pads and take out an output air pressure appearing at the other end of the rod-shaped article through the other pad when the rod-shaped article is held between the paired pads.

According to the apparatus described above, when a rod-shaped article is transported on the transportation path to reach the predetermined position, the paired pads are pressed individually against the opposite ends of the rod-shaped article, thereby holding the article between them. At this time, the respective pad faces of the paired pads undergo an elastic deformation such that their ring-shaped bulging portions embrace the respective peripheral edges of their corresponding end faces of the rod-shaped article, thereby coming airtightly into contact with the end faces of the article.

When the input air pressure is applied to the one end of the rod-shaped article through the one pad in this state, an air current from the one end to the other end is produced in the article, and the output air pressure appearing at the other end of the article is taken out through the other pad.

Since the paired pads are fully airtightly in contact with their corresponding end faces of the rod-shaped article, no gap can be formed between the pads and the end faces of the article. Thus, there is no possibility of losses in the input and output air pressures.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus, are not limitative of the present invention, and wherein.

DETAILED DESCRIPTION OF THE PREFERRED EMBODIMENTS

Figure 1:
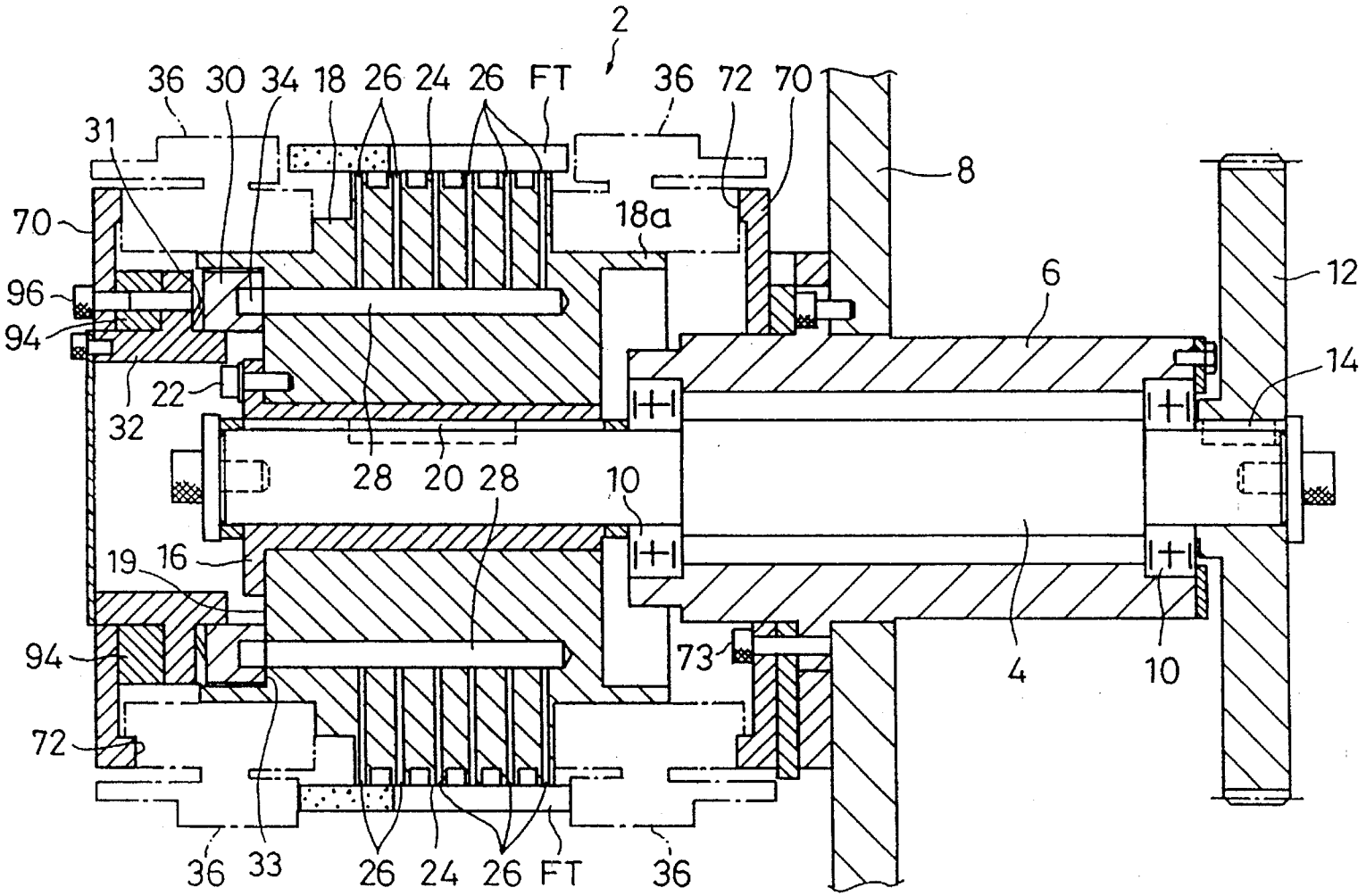
FIG. 1 is a sectional view of an inspection device taken along line I—I of FIG. 2.

An inspection device shown in FIG. 1 is incorporated in a filter cigarette manufacturing system, that is, a filter attachment or fitting filters on cigarettes or a piercing machine. The piercing machine is used to form pores in paper rings of filter cigarettes after the filter cigarettes are manufactured. In the case where the inspection device 2 is incorporated in the filter attachment, the filter attachment connects cigarettes and filters by using paper pieces with previously formed pores.

The inspection device 2 has a horizontal drive shaft 4, which is rotatably supported in a wall sleeve 6 by means of a pair of bearings 10. The wall sleeve 6, which penetrates a base wall 8, is supported by the wall 8.

One end of the drive shaft 4 projects from the wall sleeve 6, and a driving gear 12 is mounted on this projecting end by means of a key 14. The gear 12 is connected to a drive source (not shown) by means of a gear train (not shown), and the shaft 4 is rotated in one direction by means of power from the drive source.

The other end of the drive shaft 4 also projects from the wall sleeve 6, and an inspection drum 18 is mounted on the other end portion of the shaft 4 by means of a flanged sleeve 16. The shaft 4 and the sleeve 16 are coupled to each other by a key 20, while the sleeve 16 and the drum 18 are flange-connected by means of a connecting screw 22. Thus, the inspection drum 18 is rotated together with the drive shaft 4.

A number of suction grooves 24 are arranged on the outer peripheral surface of the inspection drum 18. Each groove 24 has a semicircular cross section. The suction grooves 24, which extend in the axial direction of the inspection drum 18, are arranged at regular intervals in the circumferential direction of the drum 18. Further, a plurality of circumferential grooves are formed on the outer peripheral surface of the inspection drum 18. These circumferential grooves divide each suction groove 24.

On end of each of suction holes 26 opens in the bottom of each suction groove 24. These suction holes 26, which extend diametrically through the inspection drum 18, are connected to axial bores 28. The axial bores 28 are arranged at regular intervals in the circumferential direction of the inspection drum 18, and one end of each bore 28 opens in one end face 19 of the drum 18.

A control ring 30, which is attached the end face 19 of the inspection drum 18, covers the respective openings of the axial bores 28. Fixed to a stationary ring 32, the control ring 30 is nonrotatable. The stationary ring 32 is supported by supporting means (not shown).

A spring 31, which is interposed between the control ring 30 and the stationary ring 32, presses the ring 30 against the end face 19 of the inspection drum. Thus, the inspection drum 18 rotates in a manner such that its end face 19 is airtightly in sliding contact with the control ring 30.

An annular control groove 34 is formed on an inner surface 33 of the control ring 30. When the inspection drum 18 is rotated, the respective openings of the axial bores 28 are connected in succession to the control groove 34. The control groove 34 extends over a rotational angle zone $\theta_1$ shown in FIG. 2 with respect to the rotating direction R of the drum 18. The control groove 34 is connected to a negative-pressure source (not shown), such as a blower, by means of a suction tube (not shown), so that a predetermined suction pressure is continually supplied to the groove 34.

Figure 2:
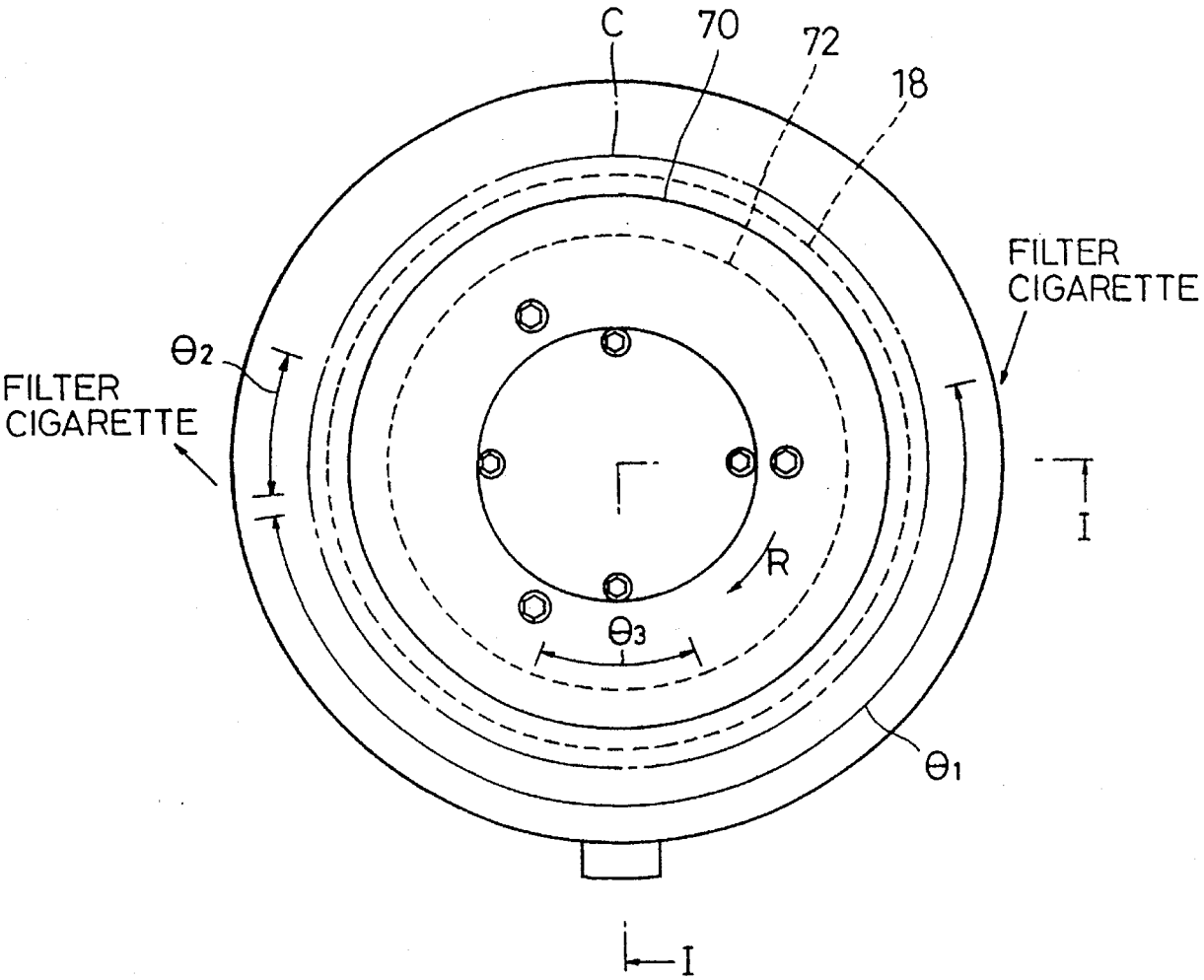
FIG. 2 is a front view of an inspection drum of the device shown in FIG. 1.

Further, a release groove (not shown), which is formed over a rotational angle zone $\theta_2$ on the Inner surface 33 of the control ring 30, communicates with the atmosphere at all times. As shown in FIG. 2, the rotational angle zone $\theta_2$ is situated at a predetermined distance from the terminal end of the rotational angle zone $\theta_1$ with respect to the rotating direction of the inspection drum 18.

When the suction grooves 24 enter the rotational angle zone $\theta_1$ as the inspection drum 18 rotates, they are connected to the control groove 34 by means of their suction holes 26 and the axial bores 28, whereby the suction pressure inside the control grooves 34 is transmitted to the suction grooves 24.

Supplied with the suction pressure, the suction grooves 24 attract and receive the filter cigarettes from that transportation drum which adjoins the upstream side of the Inspection drum 18. Thereafter, the suction grooves 24 hold and transport the filter cigarettes as they pass the rotational angle zone $\theta_1$, that is, as long as the axial bores 28 paired with the grooves 24 are connected to the control groove 34.

The inspection drum 18 and the transportation drum, in the filter attachment or piercing machine, constitutes part of a drum train for transporting the filter cigarettes or double filter cigarettes as intermediate products of the filter cigarettes. As in the case of the inspection drum 18, each drum in this drum train has suction grooves on its outer peripheral surface.

When the inspection drum 18 further rotates so that the suction grooves 24 holding the filter cigarettes enter the rotational angle zone $\theta_2$ via the rotational angle zone $\theta_1$, the axial bores 28 paired with the grooves 24 are connected to the release groove. Thereupon, the filter cigarettes are released from the suction, and are transferred to that transportation drum which adjoins the downstream side of the inspection drum 18. Thereafter, the filter cigarettes are transported as the transportation drum rotates.

Figure 3:
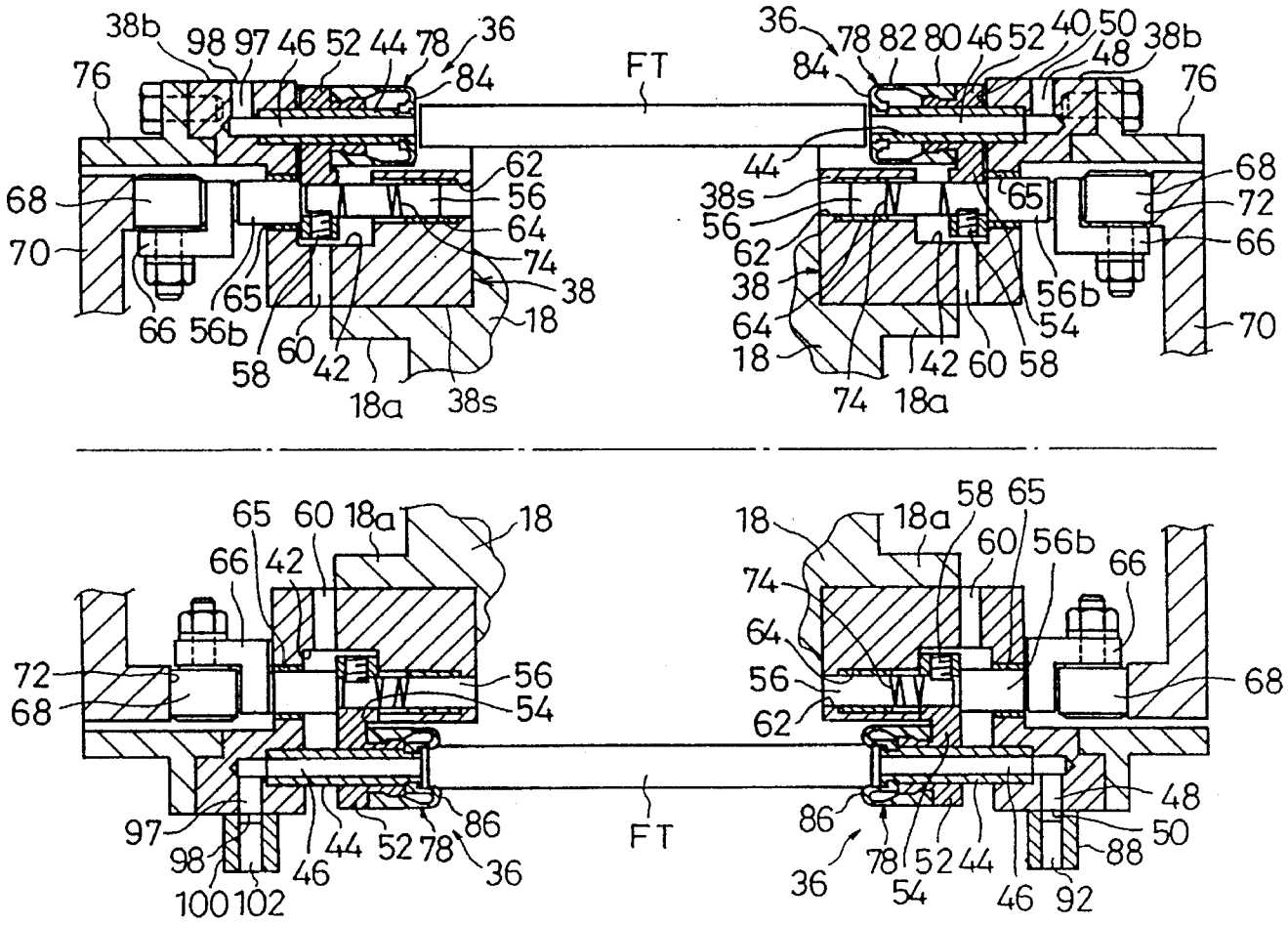
FIG. 3 is an enlarged sectional view showing pad assemblies of the inspection drum.

The inspection drum 18 is provided with a pair of pad assemblies 36 for each suction groove 24. The paired assemblies 36 are arranged on either side of their corresponding suction groove 24. In FIG. 1, the pad assemblies 36 are only represented by blocks surrounded by dashed lines. FIG. 3 shows these assemblies in detail.

The paired pad assemblies 36 for each suction groove 24 have substantially the same construction. Therefore, the following is a description of only that pad assembly 36 which is located on the right of the suction groove 24 as in FIG. 3. In FIG. 3, the central portion of the inspection drum 18 is omitted.

A ring-shaped support 18*a* protrudes sideways from the right-hand end face of the inspection drum 18 so as to be coaxial with the drum 18. A mounting ring 38, which is fixed on the support 18*a*, is rotated integrally with the inspection drum 18. The ring 38 has a stepped form having a small-diameter portion 38*s* and a large-diameter portion 38*b*. A riser face 40 of the mounting ring 38 is directed to the suction groove 24. The small-diameter portion 38*s* of the ring 38 has a circumferential groove 42 on its outer peripheral surface. One groove wall of the groove 42 is continuous with the riser face 40.

The pad assembly 36 is provided with a hollow guide pin 44 which protrudes from the riser face 40. The pin 44 is situated on the same axis with its corresponding suction groove 24. Thus, one end of an internal passage 46 of the guide pin 44 opens towards the groove 24.

The other end of the guide pin 44 is inserted in the large-diameter portion 38*b* of the mounting ring 38. One end of an input hole 48 in the large-diameter portion 38*b* is connected to the other end of the internal passage 46 of the guide pin 44. The other end of the hole 48 opens in the outer peripheral surface of the large-diameter portion 38*b*. The opening of the input hole 48 constitutes an input port 50.

A pad holder 52, which Is mounted on the guide pin 44, is slidable on the pin 44. An arm 54, which protrudes from the pad holder 52, projects into the circumferential groove of the small-diameter portion 38*s*.

A drive rod 56, which is mounted on the distal end portion of the arm 54, penetrates the arm 54 so as to extend parallel to the guide pin 44. The rod 56 is fixed to the arm 54 by means of a setscrew 58. Thus, the arm 54 or the pad holder 52 and the drive rod 56 can move integrally with each other.

Further, the small-diameter portion 38*s* of the mounting ring 38 is formed having a radial hole 60 which extends from the bottom of the circumferential groove 42 to the inner peripheral surface of the portion 38*s*. The hole 60 is used as an access hole through which the setscrew 58 is screwed into the arm 54.

One end portion of the drive rod 56 which extends from the arm 54 projects into a guide hole 62 in the small-diameter portion 38*s*. Fitted in the hole 62 is a guide sleeve 64 for guiding the drive rod 56 in sliding motion. Thus, one end of the guide hole 62 opens in one end face of the small-diameter portion 38*s*, and the other end thereof into the circumferential groove 42.

The other end portion of the drive rod 56 is formed as a rod portion 56*b* which is greater in diameter than the one end portion thereof. The rod portion 56*b* also penetrates the small-diameter portion 38*s* for sliding motion through a guide sleeve 65. If the mounting ring 38 is formed of a wear-resistant material, the guide sleeves 64 and 65 may be omitted.

An L-shaped roller holder 66 is mounted on the distal end of the large-diameter rod portion 56*b*. The roller holder 66 supports a roller 68 for rotation, and its shaft extends in the radial direction of the mounting ring 38.

A face cam 70, which is located beside the roller 68, has a cam face 72 on its outer peripheral edge. The roller 68 is continually pressed against the cam face 72 of the cam 70. More specifically, a compression coil spring 74, which surrounds the drive rod 56, is interposed between the guide sleeve 64 for guiding the one end portion of the rod 56 and the arm 54 of the pad holder 52. In other words, one end of the spring 74 is supported on an end edge of the sleeve 64 which serves as a stationary spring seat, and the other end thereof abuts against the arm 54. Thus, the compression coil spring 74 continually urges the arm 54 or the drive rod 56 toward the face cam 70. As seen from FIG. 1, the face cam 70 is fixed to the wall sleeve 6 by means of a plurality of fixing screws 73.

When the pad assembly 36 passes a predetermined rotational angle zone $\theta_3$ as the inspection drum 18 rotates, the cam face 72 of the face cam 70 applies a specific cam lift to the roller 68. As shown in FIG. 2, the rotational angle zone $\theta_3$ is covered by the rotational angle zone $\theta_1$.

Figure 4:
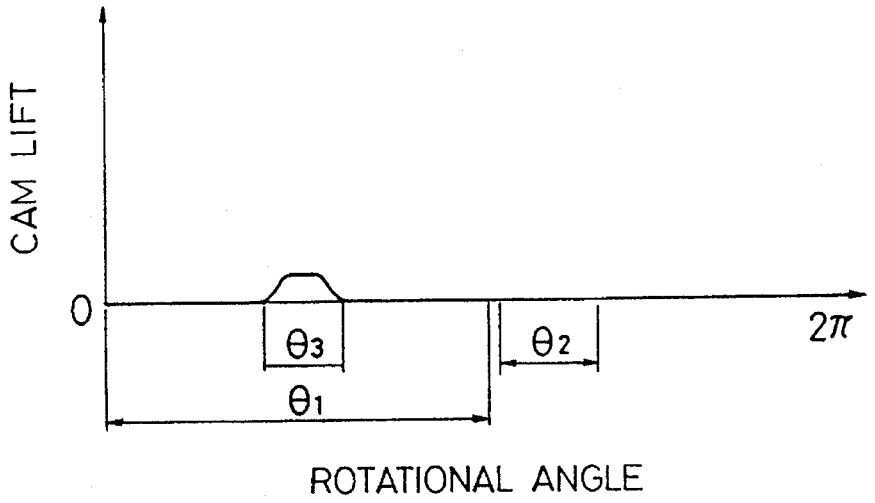
FIG. 4 is a graph illustrating the cam lift of a face cam.

Referring to FIG. 4, there is shown the cam lift of the roller 68 compared with the rotational angle of the pad assembly 36. As the pad assembly 36 passes the rotational angle zone $\theta_3$, the cam lift of the roller 68 gradually increases to its maximum, maintains the maximum for a certain period of time, and then gradually decreases, as seen from FIG. 4.

A cover ring 76 protrudes sideways from the large-diameter portion 38*b* of the mounting ring 38. The ring 76 covers the cam face 72 of the face cam 70 and the roller 68, thereby preventing penetration or inroads of contaminants between the face 72 and the roller 68.

A pad 78 is fitted on the pad holder 52 of the pad assembly 36 so as to cover the guide pin 44. The pad 78, which is formed of soft rubber, such as urethane rubber or nitrile rubber, has the shape of a hollow cylinder on the whole.

More specifically, the pad 78 includes a thick-walled proximal end portion 80 and a distal end portion 82 with a thinner wall. The proximal end portion 80 is externally airtightly connected to a fitting portion of the pad holder 52, while the distal end portion 82 is externally airtightly connected to the distal end of the guide pin 44.

Figure 5:
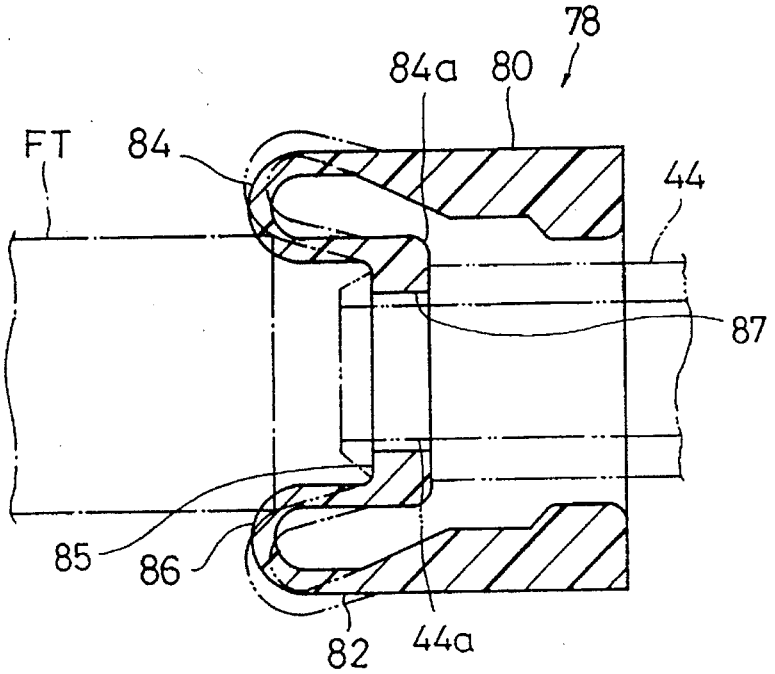
FIG. 5 is an enlarged sectional view of a pad.
Figure 6:
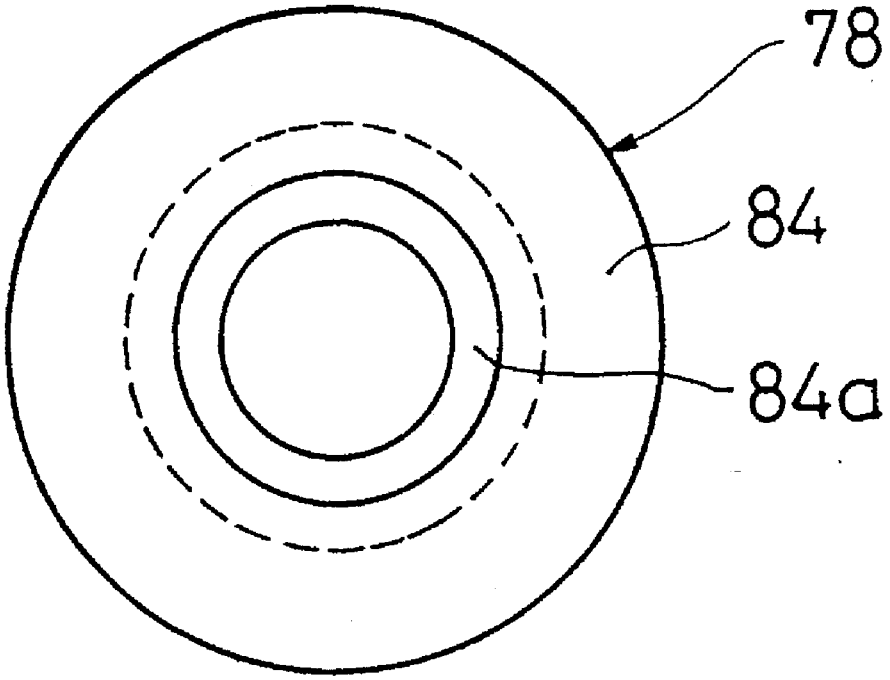
FIG. 6 is a front view of the pad shown in FIG. 5.

The end face of the distal end portion 82 of the pad 78 is formed as a pad face 84, which has a ring-shaped bulging portion 86 when in a free state. Specifically, as shown in FIGS. 5 and 6, the central portion of the pad face 84 constitutes an indentation 85 which is recessed from the thin-walled bulging portion 86, and a hole 87 is formed in the indentation 85. The peripheral portion of the hole 87 is formed as a retaining portion 84*a* which is thicker than the bulging portion 86. The retaining portion 84*a* is fixedly fitted in a retaining groove 44a at the distal end of the guide pin 44.

The outer peripheral edge of the retaining portion 84a and the distal end portion 82 are connected integrally to each other by means of the bulging portion 86. Although the outer face of the bulging portion 86 is hemispherical in shape, it may alternatively be flat.

Figure 7:
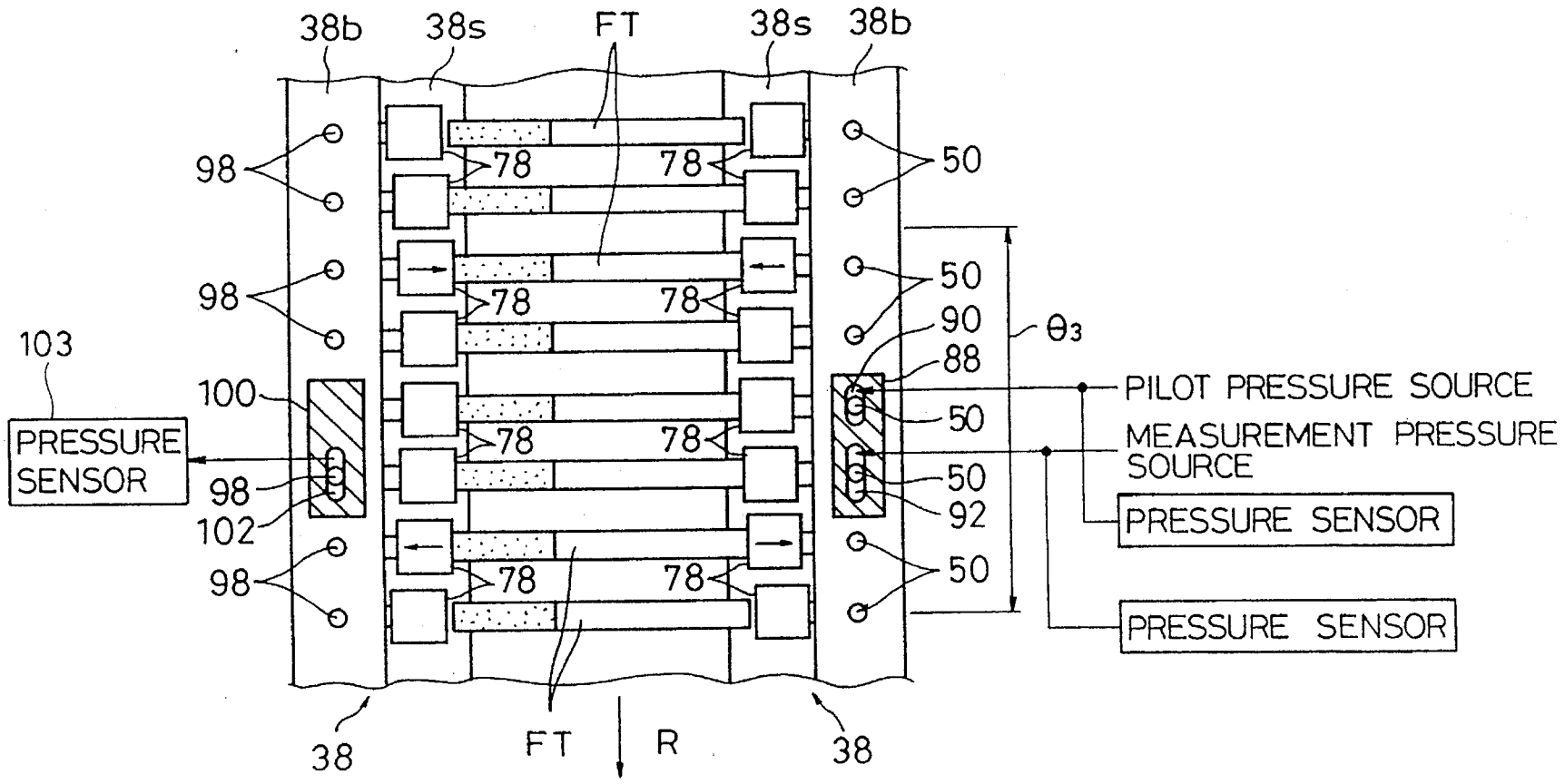
FIG. 7 is a development showing part of the outer peripheral surface of the inspection drum.

As shown in FIG. 7, an input terminal 88 is located on the outer peripheral surface of the large-diameter portion 38b of the mounting ring 38. The large-diameter portion 38b is rotated airtightly in sliding contact with the terminal 88. The input terminal 88, which is in the form of an arcuate plate, is situated within the rotational angle zone $\theta_3$.

The input terminal 88 is formed having two holes. One end of each of these holes opens in the inner peripheral surface of the terminal 88, and the other end in the outer peripheral surface of the terminal 88. As shown in FIG. 7, the trailing one of these holes, as viewed in the rotating direction of the inspection drum 18, is formed as a pilot pressure hole 90, and the other hole as a measurement pressure hole 92. The pilot pressure hole 90 and the measurement pressure hole 92 are connected to independent air pressure sources (not shown), that is, a pilot pressure source and a measurement pressure source, respectively. These sources supply the holes 90 and 92 with predetermined pilot pressure and measurement pressure, respectively. Pressure sensors 93 and 95 are connected to connecting lines between the pilot pressure source and the pilot pressure hole 90 and between the measurement pressure source and the measurement pressure hole 92, respectively.

That pad assembly 36 which is situated on the left of the inspection drum 18, as in FIG. 3, has substantially the same construction as the right-hand pad assembly, as mentioned before. In FIGS. 3 and 7, therefore, like reference numerals are used to designate like members and portions of the left-hand pad assembly 36 which have the same functions as their counterparts in the right-hand pad assembly, and a description of those members and portions is omitted. The following is a description of only differences between the left- and right-hand pad assemblies.

As seen from FIG. 1, the face cam 70 paired with the left-hand pad assembly 36 is fixed to the stationary ring 32 by means of a spacer ring 94 and a fixing screw 96.

In each left-hand pad assembly 36, an output hole 97 is used in place of the input hole 48 of the mounting ring 38. The output hole 97 has an output port 98 which opens in the outer peripheral surface of the large-diameter portion 38b of the mounting ring 38.

Further, the left-hand pad assembly 36 is combined with an output terminal 100, not the input terminal 88. The output terminal 100 is also situated within the rotational angle zone $\theta_3$. The terminal 100 is formed having one hole, which serves as a detection hole 102. The detection hole 102 is situated in the same rotational angle position as the measurement pressure hole 92 with respect to the circumferential direction of the inspection drum 18. The hole 102 is connected to a pressure sensor 103.

In FIGS. 1, 3, 5 and 7, reference symbol FT designates a filter cigarette, whose paper ring is formed having a plurality of pores.

According to the Inspection device described above, the inspection drum 18 receives the filter cigarettes FT in succession from the preceding transportation drum as it rotates, and these filter cigarettes FT are attracted to the suction grooves 24 of the drum 18.

When a filter cigarette FT is received by one of the suction grooves 24, the paired pad assemblies 36 corresponding to this groove 24 are shown on the upper side as in FIG. 3. By this time, the respective drive rods 56 of the paired assemblies 36 are moved away from the corresponding suction groove 24.

Thus, each drive rod 56 or pad holder 52 is situated in a pause position near the riser face 40 of the mounting ring 38. In this pause position, the pad holder 52 pulls the proximal end portion 80 of the pad 78 toward the riser face 40, so that the pad face 84 of the pad 78, that is, its bulging portion 86 is elastically deformed or stretched. Thus, in the case of the pad assemblies 36 on the upper side of FIG. 3, the pad face 84 of the pad 78 is spaced from its corresponding end of the filter cigarette FT.

Thereafter, the inspection drum 18 is further rotated, so that the filter cigarette FT is transported together with the suction groove 24, and enters the rotational angle zone $\theta_3$. Thereupon, the paired pad assemblies corresponding to this suction groove 24 also enter the rotational angle zone $\theta_3$. At this time, the roller 68 of each pad assembly 36 starts to be lifted by the cam face 72 of the face cam 70, and the drive rod 56 or the pad holder 52 moves toward the suction groove 24, resisting the urging force of the compression coil spring 74. As a result, the pad 78 is released from a tractive force.

When the lift of the roller 68 has a maximum, the moved distance of the drive rod 56 or the pad holder 52 also has a maximum, and the holder 52 is moved from the pause position to an operating position. In this operating position, the respective pads 78 of the paired pad assemblies 36 are pressed individually against the opposite ends of the filter cigarette FT on the suction groove 24, thereby holding the cigarette FT between them.

When the pad holder 52 is situated in the operating position, the proximal end portion 80 of the pad 78 is pushed back toward the distal end of the guide pin 44 by the pad holder 52. Thus, the pad 78 is fully released from the tractive force, so that its pad face 84 is restored to the free state. As a result, the ring-shaped bulging portion 86 is formed on the pad face 84 so as to project from the distal end of the guide pin 44. This state is indicated by each pad assembly 36 on the lower side of FIG. 3.

When the pad face 84 of each pad 78 is pressed against its corresponding end face of the filter cigarette FT with the bulging portion 86 formed in this manner, the bulging portion 86 undergoes an elastic deformation such that it embraces the end portion of the cigarette FT, and comes airtightly into contact with the peripheral edge of the end portion of the cigarette FT, as indicated by two-dot chain line in FIG. 5.

When the inspection drum 18 is further rotated to transport the filter cigarette FT to the location of the input and output terminals 88 and 100, thereafter, the input port 50 of the pad assembly 36 on the right-hand side of FIG. 3 is connected to the pilot pressure hole 90 of the input terminal 88, whereupon the pilot pressure from the pilot pressure hole 90 is introduced through the input port 50. This pilot pressure is applied to the cigarette-side end face of the filter cigarette FT through the input port 50, the input hole 48, and the internal passage 46 of the guide pin 44. At this time, on the other hand, the output port 98 of the left-hand pad assembly 36 is closed by the output terminal 100. Accordingly, the pressure in the filter cigarette FT is increased preliminarily.

When the input port 50 of the right-hand pad assembly 36 is connected to the measurement pressure hole 92 of the input terminal 88 as the rotation of the inspection drum 18 advances, the measurement pressure from the hole 92 is supplied through the input port 50, and is applied to the cigarette-side end face of the filter cigarette FT. At this time, the output port 98 of the left-hand pad assembly 36 is connected to the detection hole 102 of the output terminal 100, so that an air current directed from the cigarette-side end face to the filter-side end face is produced in the filter cigarette FT.

At this point of time, the pressure sensors 95 and 103 detect an input pressure supplied to the measurement pressure hole 92 of the input terminal 88 and an output pressure appearing at the detection hole 102 of the output terminal 100, respectively. Based on the difference between the detected input and output pressures, the dilution of the filter cigarette FT is detected. Specifically, the dilution D is calculated according to the following equation.

$$D=(P_{IN}-P_{OUT})P_{IN}\times 100(\%),$$

where $P_{IN}$ and $P_{OUT}$ are the input pressure and the detected pressure, respectively.

In detecting the dilution, the pad face 84 of each pad 78 or its bulging portion 86 is airtightly in contact with its corresponding end of the filter cigarette FT, so that there can be no gaps between the respective pad faces 84 of the pads 78 and the end faces of the filter cigarette FT. Accordingly, there is no possibility of air leaking from between the paired pads 78 and the opposite ends of the filter cigarette FT. In consequence, the pressure actually applied to the cigarette-side end face of the filter cigarette FT is equal to the input pressure $P_{IN}$, and the pressure actually appearing at the filter-side end face of the filter cigarette FT is equal to the output pressure $P_{OUT}$. Thus, the dilution D obtained from the difference between the input and output pressures takes an accurate value.

When the input and output terminals 88 and 100 are passed by the filter cigarette FT, thereafter, the lift of the roller 68 of the pad assembly 36 on each side is reduced, so that the pad holder 52, subjected to the urging force of the compression coil spring 74, is moved from the operating position to the pause position. As a result, the pad holder 52 pulls the proximal end portion 80 of the pad 78 to depress the bulging portion 84 of the pad face 84, so that the pad 78 is disengaged from the end face of the filter cigarette FT.

After undergoing this dilution inspection, the filter cigarette FT is transferred from the inspection drum 18 to the next transportation drum to be transported thereby, as mentioned before.

The present invention is not limited to the embodiment described above, and various modifications may be effected therein. According to the pad 78 of the above embodiment, for example, its pad face 84 is restored to the free state when the pad holder 52 is moved from the pause position to the operating position, and thereupon, the ring-shaped portion 86 is formed on the pad face 84. Alternatively, the pad of the present invention may be designed so that its pad face is in the free state when the pad holder 52 is in the pause position, and that the bulging portion is formed on the pad face when the holder 52 is in the operating position. Alternatively, moreover, the pad may be designed so that its pad face always has the bulging portion without regard to the position of the pad holder 52.

Although the present invention has been described as being applicable to filter cigarettes as rod-shaped articles, moreover, it is to be understood that the invention is also applicable to various other rod-shaped articles which require a dilution inspection. Furthermore, the path of transportation of the rod-shaped articles may be formed of any other suitable means than drums, and the reciprocation means for the pad holder is not limited to the illustrated one.

What is claimed is:

1. An apparatus for applying air pressure to a rod-shaped article through which air can be circulated, comprising:

transportation means for transporting a rod-shaped article having two opposite ends, said transportation means including a transportation path along which the rod-shaped article is transported in a direction generally perpendicular to the axial direction thereof;

holding means for holding the opposite ends of the rod-shaped article as the rod-shaped article is transported on the transportation path, said holding means including a pair of pads arranged on either side of the transportation path, each pad having a pad face directed to the transportation path and an elastically deformable, ring-shaped bulging portion provided on the pad face when the rod-shaped article is passing through a predetermined region of the transportation path and being adapted to be pressed against the corresponding end face of the rod-shaped article so that the ring-shaped bulging portions is elastically spread out by the peripheral edge of the corresponding end face when the rod-shaped article reaches the predetermined region, the ring-shaped bulging portion having an outer face with a rounded convex shape, the outer face of the bulging portion facing the transportation path and embracing the peripheral edge of the corresponding end face of the rod-shaped article; and input-output means for applying an input air pressure to one end of the rod-shaped article through one of the pads and for taking out an output air pressure appearing at the other end of the rod-shaped article through the other pad when the rod-shaped article is held between the paired pads.

2. The apparatus according to claim 1, wherein said transportation means includes a rotatable transportation drum having suction grooves on the outer peripheral surface thereof, the suction grooves attractively receiving and transporting the rod-shaped article as the transportation drum rotates.

3. The apparatus according to claim 2, wherein said holding means includes holders arranged on either side of each suction groove of the transportation drum and adapted to move together with the corresponding suction groove in the circumferential direction of the transportation drum as the transportation drum rotates, each holder holding the pad corresponding thereto, and forming means for forming the bulging portion on the pad face of the pad corresponding to the holder when the holder, along with the suction groove, passes a predetermined rotational angle zone as the transportation drum rotates.

4. The apparatus according to claim 3, wherein each pad is formed of a hollow cylindrical member having the pad face on one end thereof and a proximal end fixed to the holder, the cylindrical member having the ring-shaped bulging portion on the outer peripheral edge of the pad face thereof when in a free state.

5. The apparatus according to claim 4, wherein the forming means includes a guide penetrating the holder and guiding the holder in moving toward and away from the corresponding suction groove, the guide having one end connected with the center of the pad face of the pad, and reciprocating means adapted to move the holder toward the suction groove, thereby restoring the pad face to the free state, when the holder passes the rotational angle zone, and to move the holder away from the suction groove, thereby applying a tractive force to the pad face, when the holder passes any other region than the rotational angle zone.

6. The apparatus according to claim 5, wherein the reciprocating means includes cam followers provided individually for the holders and cam cooperating with the cam followers.

7. The apparatus according to claim 5, wherein said input-output means includes an internal passage formed inside the guide of each holder and opening through the pad face of the pad at the one end of the guide, supply means for supplying the input air pressure to the internal passage of the guide of the holder on one side of the suction groove from the outside of the transportation drum when the holder passes the rotational angle zone, and discharge means for discharging the output air pressure appearing in the internal passage of the guide of the holder on the other side of the suction groove to the outside of the transportation drum when the holder passes the rotational angle zone.

8. The apparatus according to claim 7, wherein the supply means and the discharge means further include pressure sensors for detecting the input and output air pressures, respectively.

9. The apparatus according to claim 1, wherein the convex outer face of the bulging portion engages a portion of a side of the rod-shaped article adjacent the peripheral edge as well as the peripheral edge of the article.

10. The apparatus according to claim 1, further comprising forming means for forming the bulging portion, the pad face having the convex bulging portion when the rod-shaped article is passing through the predetermined region of the transportation path and otherwise have a generally flat face.

* * * * *